US008464869B2

(12) United States Patent
Meyers

(10) Patent No.: US 8,464,869 B2
(45) Date of Patent: Jun. 18, 2013

(54) TOOL CASE

(71) Applicant: Milwaukee Electric Tool Corporation, Brookfield, WI (US)

(72) Inventor: Glenn Meyers, Greenfield, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 13/676,316

(22) Filed: Nov. 14, 2012

(65) Prior Publication Data

US 2013/0118939 A1 May 16, 2013

Related U.S. Application Data

(60) Provisional application No. 61/559,502, filed on Nov. 14, 2011.

(51) Int. Cl.
*B65D 85/28* (2006.01)

(52) U.S. Cl.
USPC ..... 206/377; 206/379

(58) Field of Classification Search
USPC ..... 206/372, 373, 376, 377, 378, 576, 206/379; 220/254.1, 254.2, 254.3
See application file for complete search history.

(56) References Cited

U.S. PATENT DOCUMENTS

| | | | | |
|---|---|---|---|---|
| 695,660 | A | | 3/1902 | Swan |
| 876,235 | A | | 1/1908 | Quackenboss |
| 883,906 | A | | 4/1908 | Swan |
| 888,554 | A | | 5/1908 | Tuttle |
| 1,024,388 | A | | 4/1912 | Bartlett |
| 1,450,674 | A | | 4/1923 | Marston |
| 1,770,920 | A | | 7/1930 | Hermani |
| 1,859,772 | A | | 5/1932 | Hiering |
| 1,907,107 | A | | 5/1933 | Hiering |
| 1,934,138 | A | | 11/1933 | Paul et al. |
| 2,138,916 | A | | 12/1938 | Gaess |
| 2,256,257 | A | | 9/1941 | Dukehart, Jr. |
| D153,069 | S | | 3/1949 | Linneman |
| 2,501,270 | A | | 3/1950 | Fleming |
| 2,584,721 | A | | 2/1952 | Linneman |
| 2,589,234 | A | | 3/1952 | Dorohman |
| 2,670,842 | A | | 3/1954 | Kruft |
| 2,786,380 | A | * | 3/1957 | Rolland ..... 81/440 |
| 2,827,004 | A | | 3/1958 | Luce et al. |

(Continued)

FOREIGN PATENT DOCUMENTS

| | | |
|---|---|---|
| DE | 21757 | 8/1961 |
| DE | 1927578 | 11/1965 |

(Continued)

*Primary Examiner* — Jacob K Ackun
(74) *Attorney, Agent, or Firm* — Michael Best & Friedrich LLP

(57) ABSTRACT

A multi-function tool case includes a housing body having a wall extending from a first end to a second end. The wall includes an exterior surface and an interior surface. A cavity is defined by the interior surface and extends from the first end toward the second end. An extension member extends from the exterior surface adjacent the second end and defines a socket oriented along a tool axis for receiving a first portion of an accessory for retaining a tool bit. A cover assembly is coupled to the first end. The cover assembly includes a cap portion and a first lid member rotatably coupled to the cap portion. The cap portion and the lid member are configured to substantially enclose the cavity.

20 Claims, 9 Drawing Sheets

U.S. PATENT DOCUMENTS

| | | | | |
|---|---|---|---|---|
| 3,072,244 | A | 1/1963 | Smith | |
| 3,179,278 | A | 4/1965 | Cohen | |
| 3,265,204 | A | 8/1966 | Wozniak | |
| 3,294,225 | A | 12/1966 | Kenyon | |
| 3,395,787 | A | 8/1968 | Plaskan | |
| 3,454,151 | A | 7/1969 | Plaskan | |
| 3,494,499 | A | 2/1970 | Plog et al. | |
| 3,521,810 | A | 7/1970 | Boyer | |
| 3,621,994 | A | 11/1971 | Brown | |
| 3,817,372 | A | 6/1974 | Smith | |
| 3,837,475 | A | 9/1974 | Bolanz | |
| 3,904,035 | A | 9/1975 | Metzler et al. | |
| 4,046,279 | A | 9/1977 | Rosler | |
| 4,210,253 | A | 7/1980 | Rosler | |
| 4,307,819 | A | 12/1981 | Araki | |
| 4,402,423 | A | 9/1983 | Skowronski et al. | |
| 4,445,611 | A | 5/1984 | Shofu | |
| 4,509,656 | A | 4/1985 | Rosler | |
| 4,596,340 | A | 6/1986 | Luther | |
| 4,615,464 | A | 10/1986 | Byrns | |
| 4,809,875 | A | 3/1989 | Takano | |
| 4,840,288 | A | 6/1989 | Lunderman et al. | |
| 4,884,317 | A | 12/1989 | Liu | |
| 4,909,406 | A | 3/1990 | Wu | |
| 4,930,628 | A | 6/1990 | Bridges | |
| 4,938,355 | A | 7/1990 | Rocco | |
| 5,076,428 | A | 12/1991 | Shaw | |
| 5,139,186 | A | 8/1992 | Loew et al. | |
| 5,190,154 | A | 3/1993 | Reusch | |
| 5,248,030 | A | 9/1993 | Tarozzi | |
| 5,288,453 | A | 2/1994 | Rutenbeck et al. | |
| 5,509,527 | A | 4/1996 | Wang | |
| 5,515,249 | A | 5/1996 | Shiao | |
| 5,535,882 | A | 7/1996 | Liu | |
| 5,562,208 | A | 10/1996 | Hasler et al. | |
| 5,562,212 | A | 10/1996 | Rosler | |
| 5,638,957 | A | 6/1997 | Brasier | |
| 5,642,832 | A | 7/1997 | Favre | |
| 5,680,949 | A | 10/1997 | Roesler | |
| 5,687,844 | A | 11/1997 | Budert | |
| 5,704,260 | A | 1/1998 | Huang | |
| 5,782,150 | A * | 7/1998 | Huang | 81/177.4 |
| 5,829,591 | A | 11/1998 | Lyons | |
| 5,829,596 | A | 11/1998 | Budert | |
| 5,893,457 | A | 4/1999 | Wei | |
| 5,960,744 | A | 10/1999 | Rutman | |
| 5,967,318 | A | 10/1999 | Rosler | |
| 5,992,665 | A | 11/1999 | Deeter | |
| 6,050,409 | A | 4/2000 | Delbeck et al. | |
| 6,116,447 | A | 9/2000 | Daoud | |
| 6,216,858 | B1 | 4/2001 | Chiu | |
| 6,283,291 | B1 | 9/2001 | Vasudeva et al. | |
| 6,298,857 | B1 | 10/2001 | Schmidt | |
| 6,315,408 | B1 | 11/2001 | Huang | |
| 6,352,010 | B1 | 3/2002 | Giarritta et al. | |
| 6,405,865 | B1 | 6/2002 | Lin | |
| 6,648,166 | B2 | 11/2003 | Levy | |
| 6,753,537 | B2 | 6/2004 | Woo | |
| 6,866,147 | B2 | 3/2005 | Barwick | |
| 6,988,616 | B2 | 1/2006 | Chen | |
| 7,014,058 | B2 | 3/2006 | Gledhill | |
| 7,032,483 | B2 | 4/2006 | Liu | |
| 7,168,559 | B2 | 1/2007 | Chen | |
| 7,195,120 | B2 | 3/2007 | Cunningham et al. | |
| 7,228,983 | B2 | 6/2007 | Pangerc et al. | |
| 7,237,688 | B2 | 7/2007 | Pangerc et al. | |
| 7,249,676 | B2 | 7/2007 | Wang | |
| 7,261,217 | B2 * | 8/2007 | Solowiejko | 220/254.2 |
| D550,959 | S | 9/2007 | Miller et al. | |
| 7,264,118 | B2 | 9/2007 | Chen | |
| 7,306,099 | B2 | 12/2007 | Chen | |
| 7,325,682 | B2 | 2/2008 | Seymour et al. | |
| 7,341,144 | B2 | 3/2008 | Tajiri et al. | |
| 7,360,654 | B2 | 4/2008 | Liu | |
| 7,367,451 | B2 | 5/2008 | Pendergraph et al. | |
| 7,367,467 | B2 | 5/2008 | Bashuk | |
| 7,380,660 | B2 | 6/2008 | Lin | |
| 7,401,700 | B2 | 7/2008 | Dost et al. | |
| 7,424,837 | B2 | 9/2008 | Shu | |
| 7,484,620 | B2 | 2/2009 | Miller et al. | |
| 7,530,459 | B2 | 5/2009 | Yeh | |
| 7,661,526 | B2 | 2/2010 | Lin | |
| 7,677,390 | B2 * | 3/2010 | Roesler | 206/379 |
| 7,677,391 | B2 | 3/2010 | Pistor et al. | |
| 7,854,318 | B2 | 12/2010 | Chen | |
| 7,870,956 | B1 | 1/2011 | Wang | |
| 7,900,771 | B1 | 3/2011 | Meng | |
| 8,038,004 | B2 | 10/2011 | Hu | |
| 8,083,060 | B1 | 12/2011 | Liu | |
| 2001/0008215 | A1 | 7/2001 | Colombo | |
| 2002/0179472 | A1 | 12/2002 | Lee | |
| 2004/0195113 | A1 | 10/2004 | Yoshizawa | |
| 2004/0232016 | A1 | 11/2004 | Dietrich | |
| 2005/0178695 | A1 | 8/2005 | Petit | |
| 2006/0283870 | A1 | 12/2006 | Au | |
| 2007/0114150 | A1 | 5/2007 | Lin | |
| 2007/0251355 | A1 | 11/2007 | Kao | |
| 2008/0041746 | A1 | 2/2008 | Hsiao | |
| 2010/0032327 | A1 | 2/2010 | Lai | |
| 2011/0088519 | A1 * | 4/2011 | Hu | 81/63.1 |
| 2011/0094910 | A1 | 4/2011 | Fleury et al. | |
| 2011/0120895 | A1 | 5/2011 | Hu | |
| 2012/0000805 | A1 * | 1/2012 | Liu | 206/372 |

FOREIGN PATENT DOCUMENTS

| | | |
|---|---|---|
| DE | 2431672 | 1/1976 |
| DE | 7620793 | 10/1976 |
| DE | 3211146 | 10/1983 |
| DE | 3325033 | 3/1984 |
| DE | 8913207 | 1/1990 |
| DE | 3906716 | 9/1990 |
| DE | 4005573 | 8/1991 |
| DE | 9007720 | 9/1994 |
| DE | 29606201 | 6/1996 |
| DE | 29710218 | 7/1997 |
| DE | 19620566 | 11/1997 |
| DE | 29612094 | 11/1997 |
| DE | 19724974 | 12/1998 |
| DE | 29904031 | 7/1999 |
| DE | 20318541 | 5/2005 |
| DE | 102006055025 | 5/2008 |
| DE | 102006055195 | 5/2008 |
| EP | 385055 | 9/1990 |
| EP | 443200 | 8/1991 |
| EP | 1116558 | 7/2001 |
| EP | 1332839 | 8/2003 |
| EP | 1537958 | 6/2005 |
| FR | 2797798 | 3/2001 |
| FR | 2930471 | 10/2009 |
| WO | WO 9424008 | 10/1994 |
| WO | WO 9744163 | 11/1997 |
| WO | WO 2008061854 | 5/2008 |
| WO | WO 2009138663 | 11/2009 |

* cited by examiner

TOOL CASE

CROSS-REFERENCE TO RELATED APPLICATIONS

This application claims priority to U.S. Provisional Patent Application No. 61/559,502, filed Nov. 14, 2011, the entire contents of which are incorporated by reference herein.

BACKGROUND

The present invention relates to power tools and hand tools, and in particular, the invention relates to a multi-function tool case for carrying and storing bits for use with power tools and hand tools.

Power tools and hand tools are often used in conjunction with a variety of interchangeable driver bits. Driver bits are available in various sizes and configurations for engaging, for example, a variety of fastener types. Driver bits may be interchangeable received within a bit holder.

SUMMARY

In one embodiment, the invention provides a multi-function tool case. The tool case includes a housing body having a wall extending from a first end to a second end. The wall includes an exterior surface and an interior surface. A cavity is defined by the interior surface and extends from the first end toward the second end. An extension member extends from the exterior surface adjacent the second end and defines a socket oriented along a tool axis for receiving a first portion of an accessory for retaining a tool bit. A cover assembly is coupled to the first end. The cover assembly includes a cap portion and a first lid member rotatably coupled to the cap portion. The cap portion and the lid member are configured to at least partially enclose the cavity.

In another embodiment, the invention provides multi-function tool case. The tool case includes a housing body having a wall extending from a first end to a second end. The wall has an exterior surface and an interior surface. A cavity is defined by the interior surface and extends from the first end toward the second end. The housing body further defines a socket oriented along a tool axis. A cover assembly is detachably coupled to the first end. The cover assembly includes a cap portion, a cover extension portion, and a first lid member rotatably coupled to the cap portion. The cap portion at least partially encloses the cavity. The cover extension portion defining an aperture oriented along the tool axis. The aperture and socket are configured to receive tool bit holder, and wherein the lid member selectively encloses the aperture.

Before any constructions of the invention are explained in detail, it is to be understood that the invention is not limited in its application to the details of construction and the arrangement of components set forth in the following description or illustrated in the following drawings. The invention is capable of other constructions and of being practiced or of being carried out in various ways.

DETAILED DESCRIPTION

Figure 1:
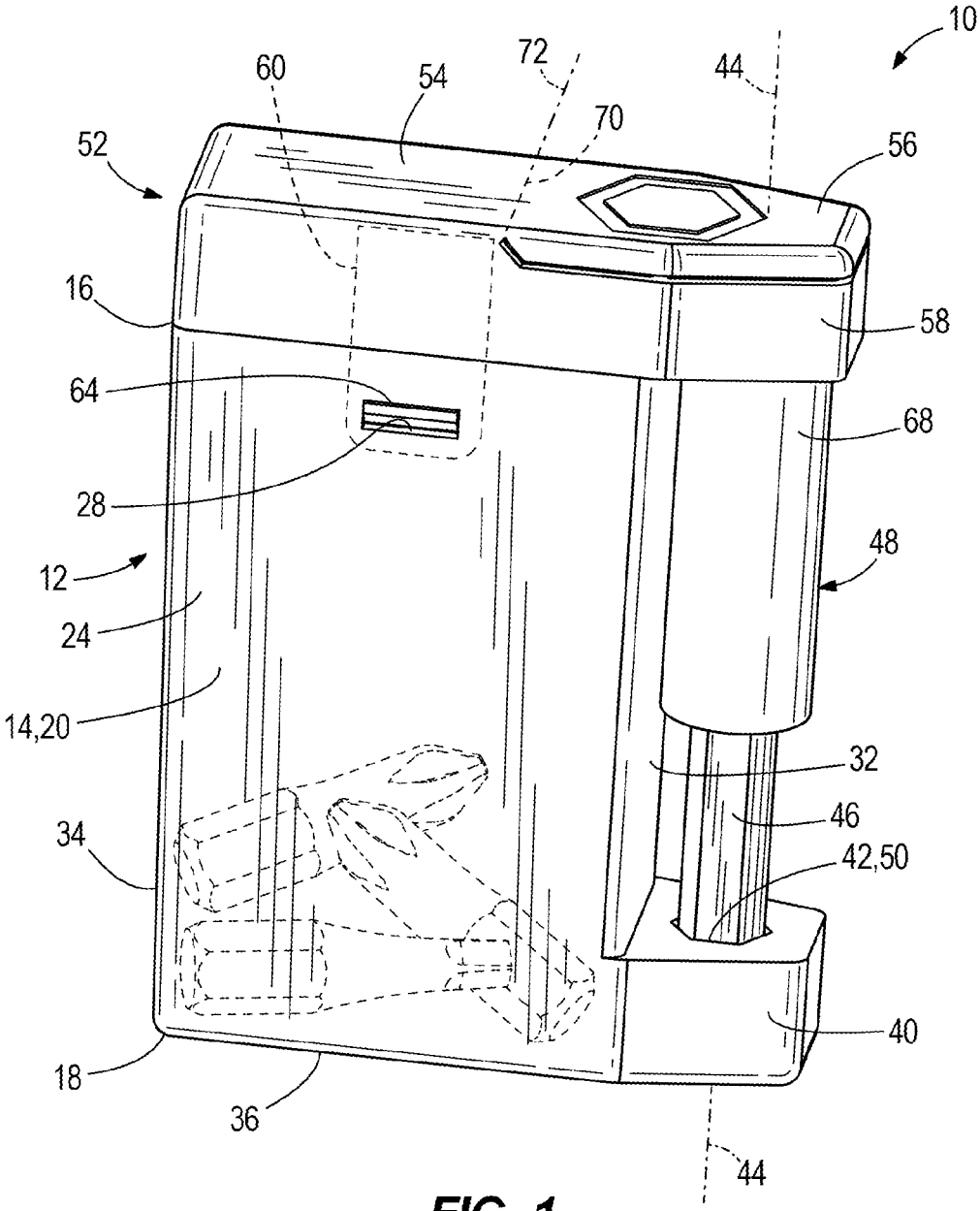
FIG. 1 is a perspective view of a tool case according to one construction of the invention.

Referring to FIG. 1, a storage vessel, more specifically a multi-function tool case 10, includes a housing body 12. The housing body 12 includes a wall 14 extending from a first end 16 and to a second end 18 of the housing body 12. The wall 14 has an outer surface 20 and, referring to FIG. 2, an inner surface 22.

Figure 2:
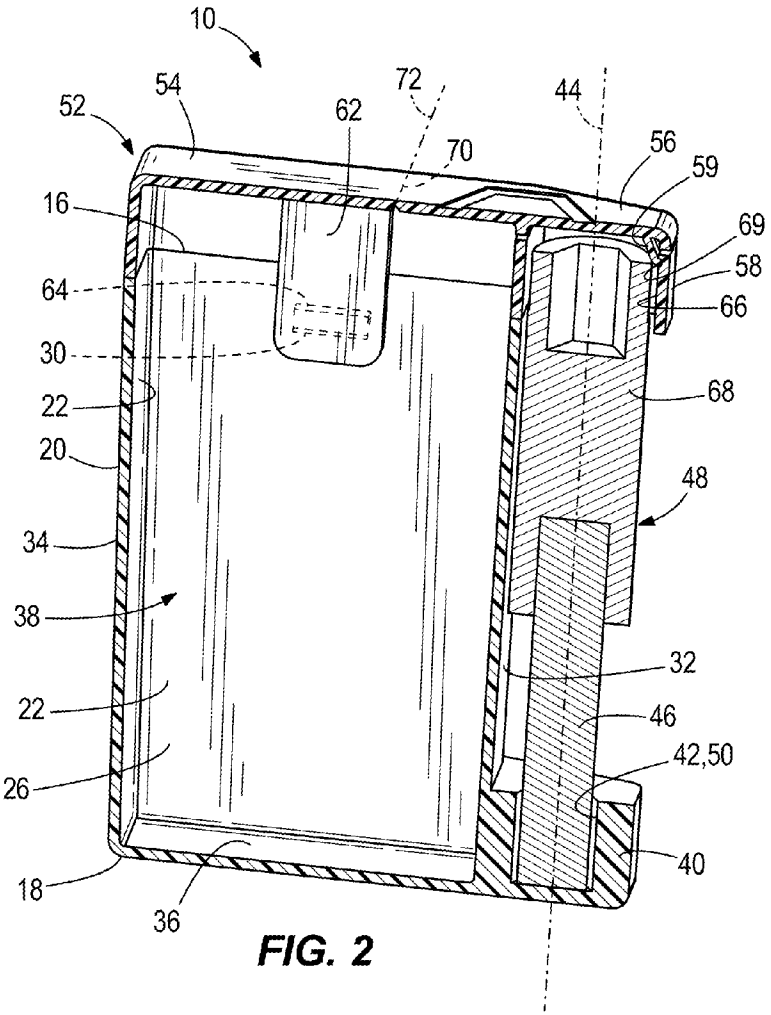
FIG. 2 is a cutaway view of the tool case of FIG. 1.

The wall 14 defines a first side wall portion 24 (FIG. 1) and a second side wall portion 26 (FIG. 2). The first side wall portion 24 defines a first cover engagement aperture 28. The second side wall portion 26 defines a second cover engagement aperture 30.

A first connecting wall portion 32 and a second connecting wall portion 34 each extend between the first side wall portion 24 and the second side wall portion 26, such that the wall 14 defines a substantially rectangular cross section of the housing body 12 from the first end 16 to the second end 18.

A base wall portion 36 substantially encloses the second end 18 of the housing body 12. Referring to FIG. 2, the inner surface 22 defines a receptacle cavity 38 extending from the first end 16 to the base wall portion 36.

Referring to FIG. 1, a lateral extension member 40 of the housing body 12 extends in cantilever fashion from the first connecting wall portion 32 adjacent the second end 18. The lateral extension member 40 may be integrally formed as one with the wall 14. Referring to FIG. 2, the lateral extension member 40 defines a socket 42 oriented along a tool axis 44. The socket 42 is configured for receiving a shank 46 of a tool bit holder 48. The tool bit holder 48 may include, for example, a drive guide. Referring to FIG. 1, the socket 42 has a hexagonal cross-sectional profile 50, such as for receiving a ¼" hexagonal shank. In other constructions, the socket may have a square cross-sectional profile, such as for receiving a bit holder with a square shank profile. The socket may include various retention means, such as a magnet, a resilient member, a spring clip, a ball detent, etc. In still other constructions, the tool case may configured to hold two or more tool bit holders, drive guides, or other accessories.

Figure 3:
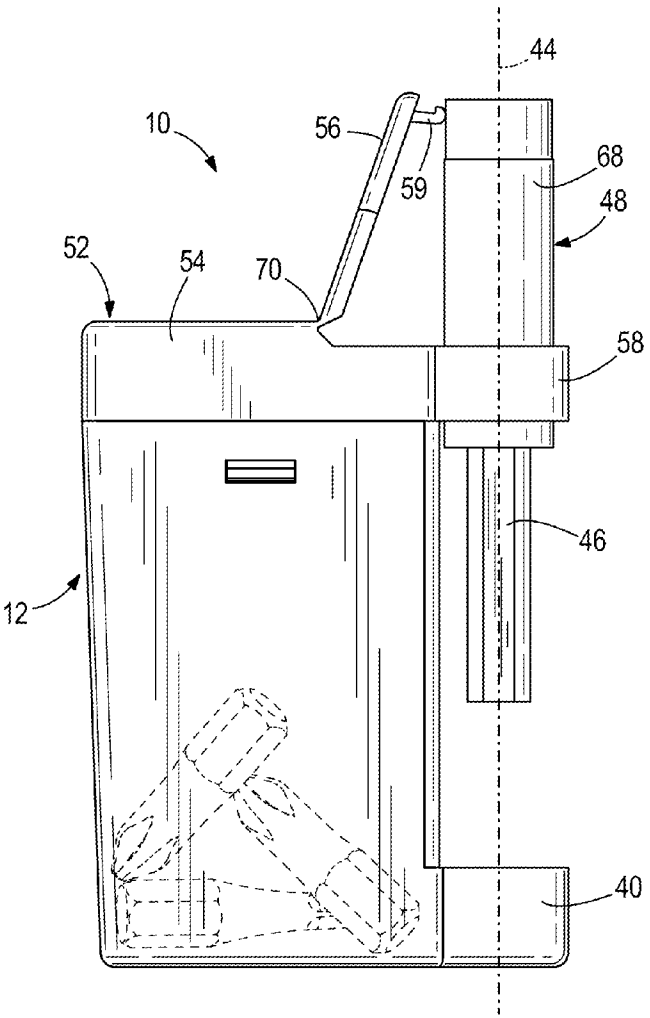
FIG. 3 is a front view of the tool case of FIG. 1, with a lid member in an open orientation.

Referring to FIG. 1, a cover assembly 52 is coupled to the housing body first end 16. The cover assembly 52 includes a cap portion 54, a lid member 56, and a cover extension portion 58. Referring to FIG. 3, a tab member 59 extends from the lid member 56 for securing the lid member 56 to the cover extension portion 58. The cap portion 54 includes a first connecting arm 60 (FIG. 1) and a second connecting arm 62 (FIG. 2). Each of the first connecting arm 60 and the second connecting arm 62 defines a tab member 64 for detachably engaging the respective engagement aperture 28, 30 of the housing body 12, thereby securing the cover assembly 52 to the housing body 12. In other constructions, the cover assembly 52 may be secured to the housing body 12 with more than two connecting arms. In still other constructions, the cover assembly may be secured to the housing body by a resilient lip and groove arrangement, friction fit, adhesives, or other fastening means.

The cover extension portion 58 extends in cantilever fashion from the cap portion 54. Referring to FIG. 2, the cover extension portion 58 defines an aperture 66 oriented along the tool axis 44. The aperture 66 is configured to receive a portion of the tool bit holder 48, more specifically, a drive-end body 68 of the tool bit holder 48. The cover extension portion 58 also defines a lid engagement aperture 69 for detachably receiving the tab member 59 when the lid member 56 is in a closed position as shown in FIGS. 1 and 2.

The lid member 56 is pivotally coupled to the cap portion 54 via a hinge, more specifically, a live hinge 70 integrally connecting the cap portion 54 and the lid member 56 (FIG. 3) along a hinge axis 72 (FIG. 1).

With the lid member 56 in a closed position, as illustrated in FIGS. 1 and 2, the receptacle cavity 38 is substantially enclosed by the cap portion 54 and the lid member 56, while the aperture 66 is enclosed by the lid member 56. Furthermore, the tool bit holder 48 is substantially captured within the tool case 10 by the lid member 56, the cover extension portion 58, and the extension member 40.

With reference to FIG. 3, the lid member 56 may be pivoted to an open orientation in order to provide access to the receptacle cavity 38 (FIG. 2), as well as for releasing the tool bit holder 48. With the lid member 56 in the open orientation (FIG. 3), the tool bit holder 48 may be withdrawn through the aperture 66 (FIG. 2) along the tool axis 44, while bits or other objects may be withdrawn from the receptacle cavity 38 (FIG. 2)

Figure 4:
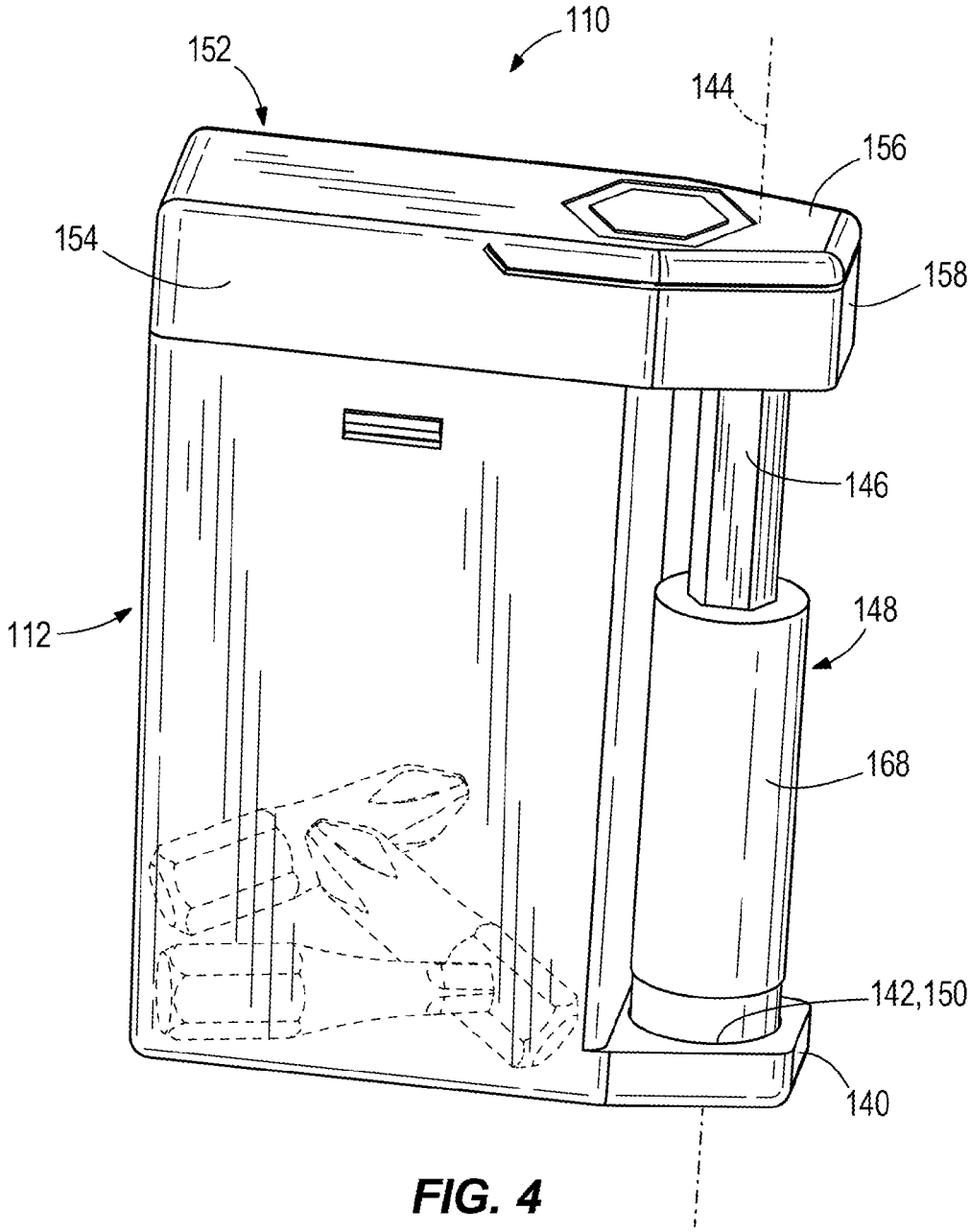
FIG. 4 is a perspective view of a tool case according to another construction of the invention.
Figure 6:
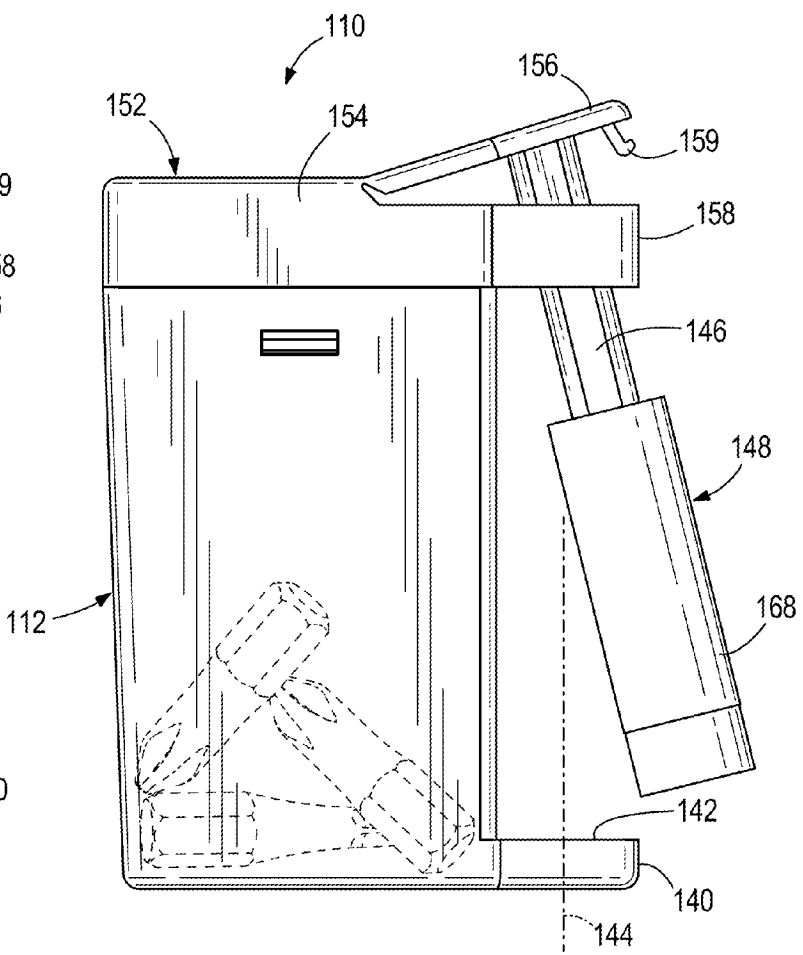
FIG. 6 is a front view of the tool case of FIG. 4, with a lid member in an open orientation.
Figure 5:
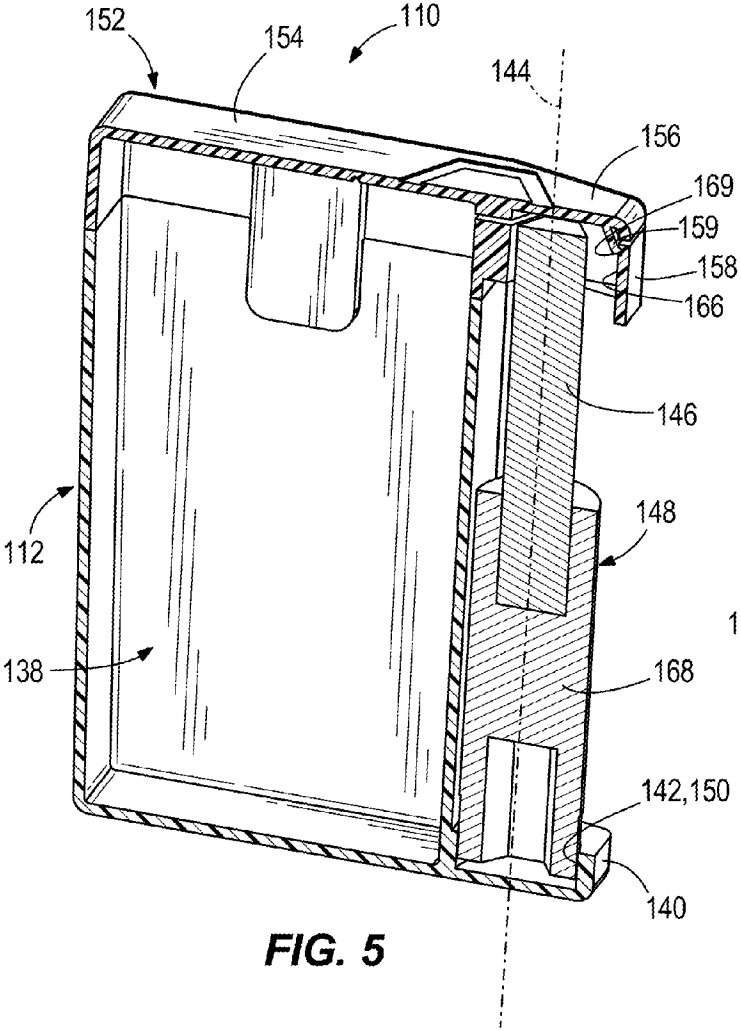
FIG. 5 is a cutaway view of the tool case of FIG. 4.

FIGS. 4-6 illustrate a tool case 110 according to another construction of the invention. Similar components to those identified with respect to the construction of FIGS. 1-3 have been given identical reference numerals, plus "100." Only those features that differ from the construction of FIGS. 1-3 are described herein.

The tool case 110 includes a housing body 112 having an extension member 140. The extension member 140 defines a socket 142. The socket 142 has a round cross-sectional profile 150 configured for receiving a drive-end body 168 of a tool bit holder 148.

A cover assembly 152 includes a cover extension portion 158. Referring to FIG. 5, the cover extension portion 158 defines an aperture 166 configured to receive a shank 146 of the tool bit holder 148, but not large enough to receive the drive end body 168. The cover extension portion 158 defines a lid engagement aperture 169.

The cover assembly 152 further includes a lid member 156 having a tab member 159. With the lid member 156 in a closed orientation, as illustrated in FIGS. 4 and 5, the tool bit holder 148 is substantially captured within the tool case 110 by the lid member 156, the cover extension portion 158, and the extension member 140.

Referring to FIG. 6, with the lid member 156 in an open orientation, the tool bit holder 148 can be lifted along a tool axis 144 such that a shank 146 of tool bit holder 148 extends beyond the cover extension portion 158 and the drive end body 168 clears the socket 142. The tool bit holder 148 may then be rotated away from the tool axis 144 and removed from the tool case 110 entirely. Similarly, bits or other objects may be withdrawn from the receptacle cavity 138 (FIG. 5)

Figure 7:
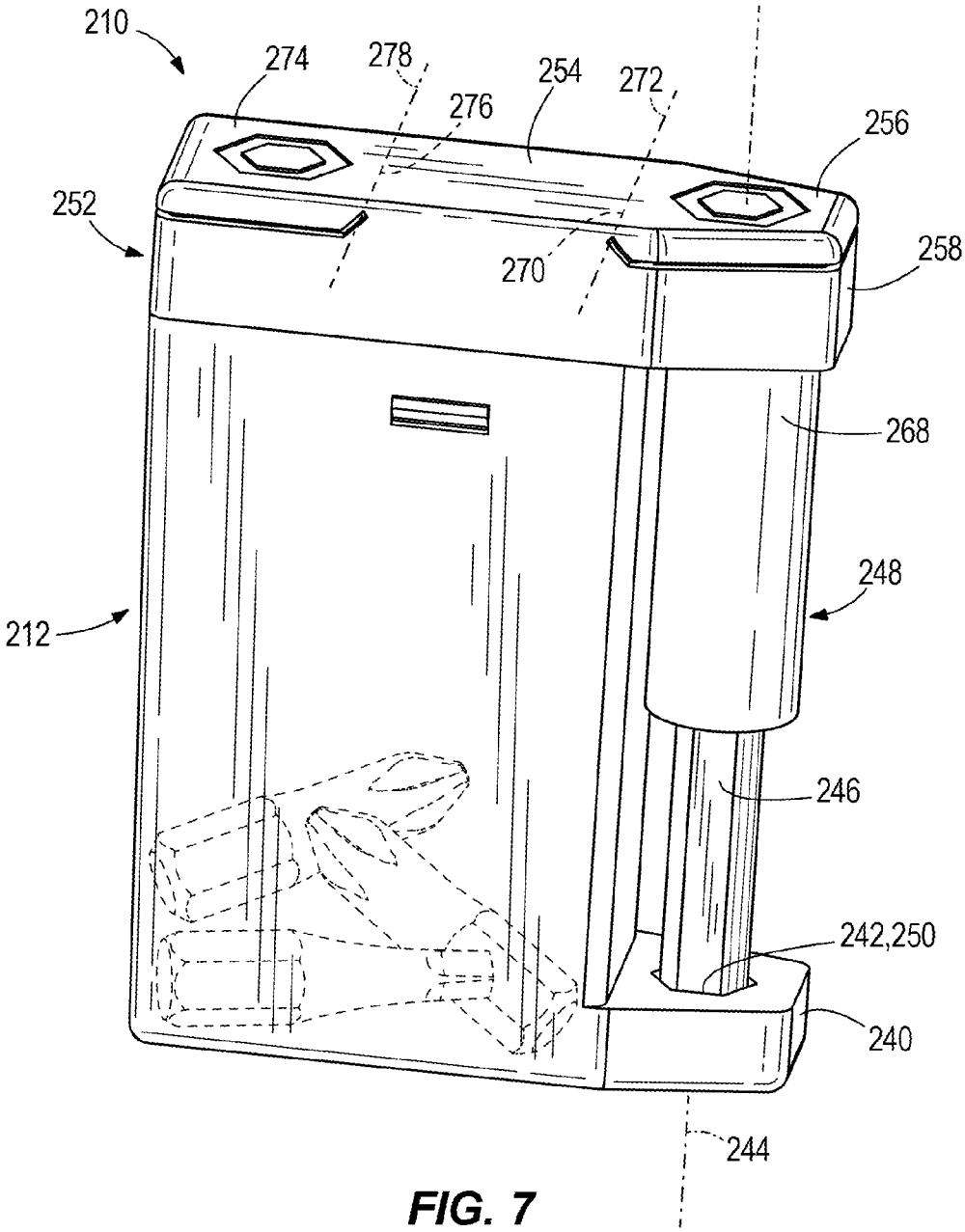
FIG. 7 is a perspective view of tool case according to yet another construction of the invention.
Figure 9:
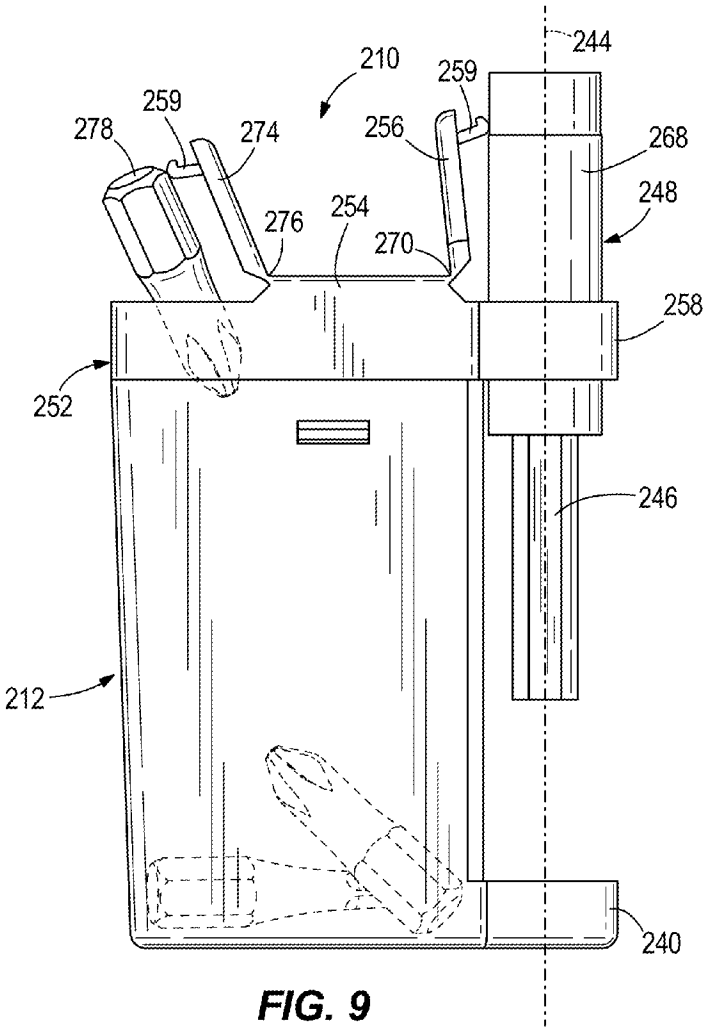
FIG. 9 is a front view of the tool case of FIG. 7, with a first lid member in an open orientation and a second lid member in an open orientation.
Figure 8:
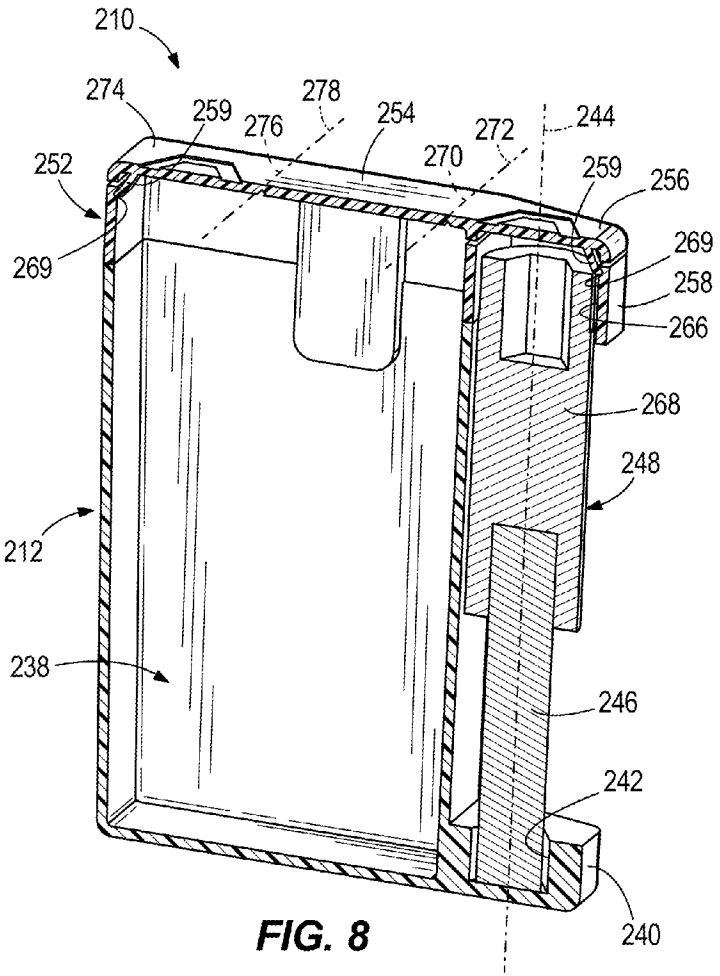
FIG. 8 is a cutaway view of the tool case of FIG. 7.

FIGS. 7-9 illustrate a tool case 210 according to yet another construction of the invention. Similar components to those identified with respect to the construction of FIGS. 1-3 have been given identical reference numerals, plus "200." Only those features that differ from the construction of FIGS. 1-3 are described herein.

Referring to FIG. 7, the tool case 210 includes a housing body 212 including an extension member 240. The extension member 240 defines a socket 242. The socket 242 has a hexagonal cross-sectional profile 250 configured for receiving a shank 246 of a tool bit holder 248.

A cover assembly 252 includes a cover extension portion 258. Referring to FIG. 8, the cover extension portion 258 defines an aperture 266 configured to receive a drive end body 268 of the tool bit holder 248. The cover assembly defines lid engagement apertures 269.

The cover assembly 252 further includes a first lid member 256 pivotally coupled to a cap portion 254 about a first live hinge 270 disposed along first hinge axis 272. A second lid member 274 is pivotally coupled to the cap portion 254 about a second live hinge 276 disposed along a second hinge axis 278. The second lid member 274 provides selective access to a receptacle cavity 238, while the first lid member 256 selectively captures the tool bit holder 248. The first lid member 256 and the second lid member 274 each include a tab member 259 selectively received into the respective lid engagement apertures 269 for securing each lid member 256, 274 to the cover extension portion 258.

With the first lid member 256 in a closed orientation, as shown in FIGS. 7-8, the tool bit holder 248 is substantially captured within the tool case 210 by the lid member 256, the cover extension portion 258, and the extension member 240. With the second lid member 274 closed, a receptacle cavity 238 (FIG. 8) is substantially enclosed by the cap portion 254 and second lid member 256.

Referring to FIG. 9, with the first lid member 256 in the open orientation, the tool bit holder 248 may be withdrawn through the aperture 266 along the tool axis 244. With the second lid member 274 in an open orientation, bits or other objects may be withdrawn from the receptacle cavity 238 (FIG. 8).

Figure 10:
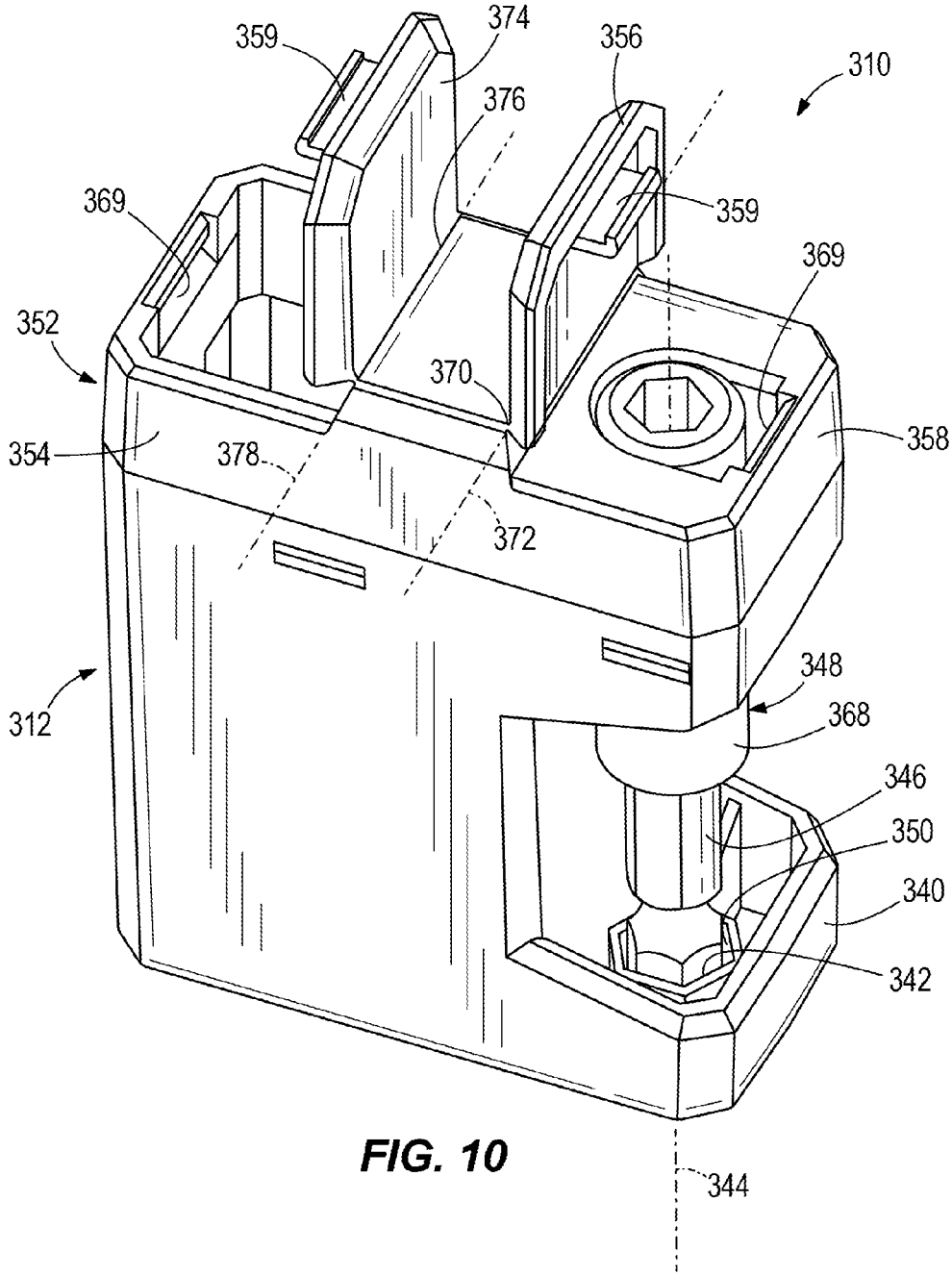
FIG. 10 is a perspective view of a tool case according to another construction of the invention.
Figure 11:
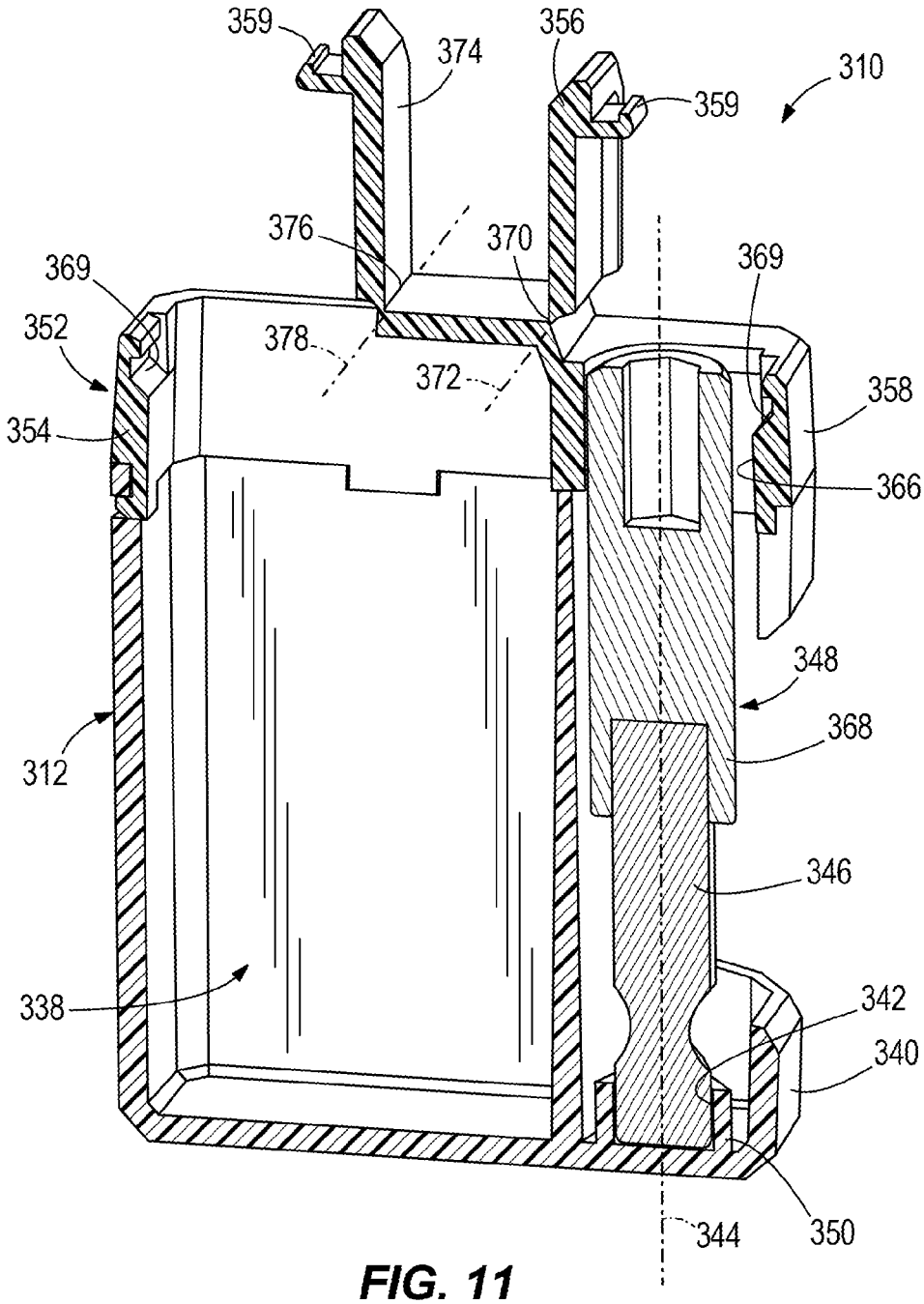
FIG. 11 is a cutaway view of the tool case of FIG. 10.
Figure 12:
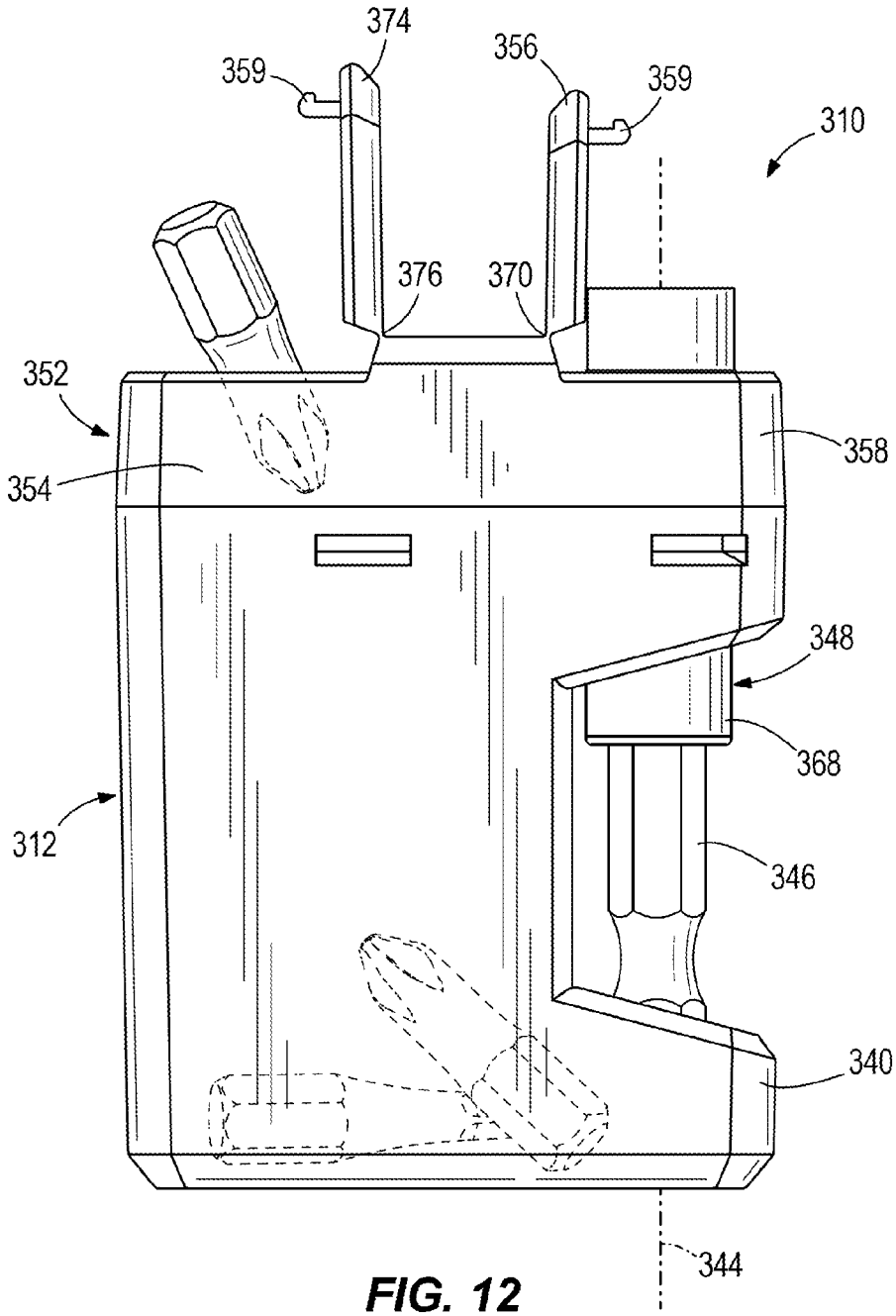
FIG. 12 is a front view of the tool case of FIG. 10, with a first lid member in an open orientation and a second lid member in an open orientation.

FIGS. 10-12 illustrate a tool case 310 according to yet another construction of the invention. Similar components to those identified with respect to the construction of FIGS. 1-3 have been given identical reference numerals, plus "300." Only those features that differ from the construction of FIGS. 1-3 are described herein.

A cover assembly 352 includes a cover extension portion 358. Referring to FIG. 10, the cover extension portion 358 defines an aperture 366 configured to receive a drive end body 368 of the tool bit holder 348. The cover assembly 352 defines lid engagement apertures 369.

The cover assembly 352 further includes a first lid member 356 pivotally coupled to a cap portion 354 about a first live hinge 370 disposed along first hinge axis 372. A second lid member 374 is pivotally coupled to the cap portion 354 about a second live hinge 376 disposed along a second hinge axis 378. The second lid member 374 provides selective access to a receptacle cavity 338, while the first lid member 356 selectively captures the tool bit holder 348. The first lid member 356 and the second lid member 374 each include a tab member 359 selectively received into the lid engagement apertures 369 for securing each lid member 356, 374 to the cover extension portion 358.

Referring to FIG. 11, with the first lid member 356 in the open orientation, the tool bit holder 348 may be withdrawn through the aperture 366 along the tool axis 344. Referring to FIGS. 10 and 11, the lateral extension member 340 defines a socket 342 oriented along a tool axis 344. The socket 342 is configured for receiving a shank 346 of a tool bit holder 348. Referring to FIG. 11, the socket 342 has a hexagonal cross-sectional profile 350, such as for receiving a ¼" hexagonal shank. In other constructions, the socket may have a square cross-sectional profile, such as for receiving a bit holder with a square shank profile. The socket may include various retention means, such as a magnet, a resilient member, a spring clip, a ball detent, etc.

With the second lid member 374 in an open orientation as shown in FIG. 12, bits or other objects may be withdrawn from the receptacle cavity 338.

Thus, the invention provides, among other things, a multi-function tool case.

The invention claimed is:

1. A multi-function tool case comprising:

a housing body having a wall extending from a first end to a second end, the wall having an exterior surface and an interior surface with a cavity defined by the interior surface and extending from the first end toward the second end;

an extension member extending from the exterior surface adjacent the second end and defining a socket oriented along a tool axis for receiving a first portion of an accessory for retaining a tool bit; and a cover assembly coupled to the first end, the cover assembly including a cap portion and a first lid member rotatably coupled to the cap portion, the cap portion and the first lid member configured to at least partially enclose the cavity.

2. The multi-function tool case of claim 1, wherein the cover assembly further includes a cover extension portion defining an aperture oriented along the tool axis, the aperture configured to receive a second portion of the accessory.

3. The multi-function tool case of claim 2, wherein the first lid member encloses the aperture when in a closed position.

4. The multi-function tool case of claim 1, wherein the accessory is positioned such that it can be withdrawn from the socket along the tool axis.

5. The multi-function tool case of claim 1, wherein the accessory is positioned such that it can be withdrawn from the socket at a non-parallel angle to the tool axis.

6. The multi-function tool case of claim 1, wherein the socket has a hexagonal cross-sectional profile.

7. The multi-function tool case of claim 1, further comprising a second lid member pivotally coupled to the cap portion to provide selective access to the cavity.

8. The multi-function tool case of claim 7, wherein the second lid member is coupled to the cap portion via a live hinge.

9. The multi-function tool case of claim 1, wherein the wall includes a side wall portion having a cover engagement aperture.

10. The multi-function tool case of claim 9, wherein the cap portion further includes a connecting arm defining a tab member for detachably engaging the engagement aperture.

11. The multi-function tool case of claim 1, wherein the first lid member is coupled to the cap portion via a live hinge.

12. A multi-function tool case comprising:

a housing body having a wall extending from a first end to a second end, the wall having an exterior surface and an interior surface with a cavity defined by the interior surface and extending from the first end toward the second end, the housing body further defining a socket oriented along a tool axis; and a cover assembly detachably coupled to the first end, the cover assembly including a cap portion, a cover extension portion, and a first lid member rotatably coupled to the cap portion, the cap portion at least partially enclosing the cavity, the cover extension portion defining an aperture oriented along the tool axis, the aperture and socket configured to receive tool bit holder, and wherein the lid member selectively encloses the aperture.

13. The multi-function tool case of claim 12, wherein the socket has a round cross-sectional profile.

14. The multi-function tool case of claim 12, wherein the socket has a hexagonal cross-sectional profile.

15. The multi-function tool case of claim 12, wherein the first lid member selectively, substantially covers the aperture.

16. The multi-function tool case of claim 12, wherein the first lid member is coupled to the cap portion via a live hinge.

17. The multi-function tool case of claim 12, further comprising a second lid member pivotally coupled to the cap portion to provide selective access to the cavity.

18. The multi-function tool case of claim 12, wherein the wall includes a first side wall portion having a first cover engagement aperture and a second side wall portion having a second cover engagement aperture.

19. The multi-function tool case of claim 18, wherein the cap portion further includes a first connecting arm and a second connecting arm, each of the first connecting arm and the second connecting arm defining a tab member for detachably engaging the respective engagement aperture.

20. The multi-function tool case of claim 12, wherein the first lid member is configured to pivot to an open orientation to provide access to the cavity and to release the tool bit holder.

* * * * *